US010096434B2

(12) United States Patent
Kowanda

(10) Patent No.: US 10,096,434 B2
(45) Date of Patent: Oct. 9, 2018

(54) CONTACT COMPONENT AND METHOD FOR THE PRODUCTION THEREOF

(71) Applicant: PLANSEE POWERTECH AG, Seon (CH)

(72) Inventor: Claudia Kowanda, Oberaegeri (CH)

(73) Assignee: Plansee Powertech AG, Seon (CH)

( * ) Notice: Subject to any disclaimer, the term of this patent is extended or adjusted under 35 U.S.C. 154(b) by 876 days.

(21) Appl. No.: 14/403,255

(22) PCT Filed: May 29, 2013

(86) PCT No.: PCT/IB2013/001294
§ 371 (c)(1),
(2) Date: Nov. 24, 2014

(87) PCT Pub. No.: WO2013/179135
PCT Pub. Date: Dec. 5, 2013

(65) Prior Publication Data

US 2015/0155110 A1 Jun. 4, 2015

(30) Foreign Application Priority Data

Jun. 1, 2012 (AT) ..... GM238/2012

(51) Int. Cl.
*B22F 7/08* (2006.01)
*H01H 1/025* (2006.01)
(Continued)

(52) U.S. Cl.
CPC ..... *H01H 1/025* (2013.01); *H01H 1/02* (2013.01); *H01H 1/0206* (2013.01); *H01H 11/04* (2013.01); *H01H 11/048* (2013.01); *H01H 2201/026* (2013.01); *H01H 2201/03* (2013.01); *Y10T 29/49206* (2015.01)

(58) Field of Classification Search
None
See application file for complete search history.

(56) References Cited

U.S. PATENT DOCUMENTS 5,241,745 A 9/1993 Kippenberg
5,852,266 A * 12/1998 Komuro ..... B22F 3/26 200/279

(Continued)

FOREIGN PATENT DOCUMENTS

AT 286423 B 12/1970
CN 1381857 A 11/2002

(Continued)

OTHER PUBLICATIONS

Li Linsheng et al., "A New Method of Directional Solidification of In-situ Composite Cu Cr Alloy", Journal of Guangdong, University of Technology, vol. 22, No. 2, Jun. 30, 2005—English translation.

*Primary Examiner* — Jessee R Roe
*Assistant Examiner* — Ngoclan T Mai
(74) *Attorney, Agent, or Firm* — Laurence A. Greenberg; Werner H. Stemer; Ralph E. Locher

(57) ABSTRACT

An electrical contact component and a method for the production thereof. The contact component has a sintered contact element and a contact carrier cast onto the contact element. The grains of the contact element are oriented in a preferential direction.

15 Claims, 4 Drawing Sheets

(51) Int. Cl.
*H01H 1/02* (2006.01)
*H01H 11/04* (2006.01)

(56) References Cited

U.S. PATENT DOCUMENTS

| | | | |
|---|---|---|---|
| 6,524,525 | B2 | 2/2003 | Hauner et al. |
| 6,765,167 | B2 | 7/2004 | Kikuchi et al. |
| 2001/0036418 | A1 | 11/2001 | Hauner et al. |

FOREIGN PATENT DOCUMENTS

| | | | |
|---|---|---|---|
| CN | 202550233 | U | 11/2012 |
| DE | 1958044 | A1 | 7/1970 |
| EP | 1022759 | A2 | 7/2000 |
| EP | 1130608 | A2 | 9/2001 |
| EP | 1249848 | A2 | 10/2002 |
| JP | H04505986 | A | 10/1992 |
| JP | H1012074 | A | 1/1998 |
| JP | 2001351451 | A | 12/2001 |
| JP | 2002313196 | A | 10/2002 |
| WO | 9515425 | A1 | 12/1990 |

* cited by examiner

CONTACT COMPONENT AND METHOD FOR THE PRODUCTION THEREOF

BACKGROUND OF THE INVENTION

Field of the Invention

The invention relates to a contact component for electrical switches and to a method for producing such a contact component.

AT 286423 B discloses an electrical contact with a skeletal body of sintered tungsten, which is impregnated with a copper alloy, and a cast-on contact carrier of the impregnating material. The copper alloy comprises 0.1 to 1.2% chromium and optionally 0.1 to 8% silver. After the casting-on of the contact carrier, the electrical contact is subjected to a heat treatment or hardened, in order to produce a contact carrier with great hardness and high electrical conductivity.

BRIEF SUMMARY OF THE INVENTION

The object of the invention is to provide an improved electrical contact component and a method for producing such a contact component.

This object is achieved by the features of the independent claims. Advantageous refinements are the subject of the subclaims.

The novel electrical contact component has a sintered contact element and a contact carrier cast onto the contact element. In other words, the sintered contact element and the cast-on contact carrier together form an electrical contact component, for example for electrical switches in the medium voltage range or in the high voltage range. In particular, both the contact element and the contact carrier are electrically conducting. For example, for a circuit breaker in the high voltage range, a contact component may be formed as a tube element, such as for example a tulip or erosion tulip. A further contact component may be formed or shaped as a pin or erosion pin, which engages in the tulip, so that with the two contact components a contact of an electrical switch can be closed.

The contact element is sintered, i.e. it has a multiplicity of adjoining grains. According to the invention, the grains of the contact element are oriented in a preferential direction, or the grains of the contact element have a preferential direction or preferential orientation. For example, the grains are of an elongated form or the grain form of the contact element is elongated and the grains and the longitudinal axis thereof are oriented along the preferential direction. For example, after the sintering, the contact element is in a cold-worked state or undergoes cold working, so that the grains of the contact element are in an elongated form and oriented along a preferential direction or made to be so. In other words, the grains of the contact element have an orientation and form that have a preferential direction as a result of (mechanical) working.

It has been found that orienting the grains along a preferential direction or forming a (elongated) grain form that is oriented in a preferential direction has the effect that the contact element has a lower electrical resistance in the preferential direction. In other words, the contact element or the contact component can conduct current with less loss in the preferential direction.

The contact component is preferably in a cold-worked state after the casting-on of the contact carrier, so that the grains of the contact element have a preferential direction and, in addition, the contact carrier is hardened by the cold working. In other words, the contact element and the contact carrier undergo cold working together after the casting of the contact carrier onto the contact element. It has been found that the usually harder, and consequently more brittle, material of the contact element that is connected to the contact carrier can be deformed in a great range without the formation of (stress) cracks after the casting-on of the contact carrier material. In other words, a particularly robust and low-loss contact component that can be produced in a simple and time-saving way is provided. In particular, the advantageous orientation and grain form of the contact element described above is provided in just one working step—that is the cold working—and at the same time the contact carrier or the contact carrier material is hardened.

To sum up, a reproducible profile of properties can be achieved for each individual contact component by means of the cold working described, irrespective of process-related variations of the strength properties of melt-metallurgically produced starting materials for the contact carrier. For example, a homogeneous microstructure of the carrier material and of the contact element can be reproducibly set by way of the degree of working. In particular in comparison with AT 286423B, which provides a time-intensive heat treatment for the hardening of the carrier material, the contact component described here can be hardened quickly, and consequently at low cost, by the cold working.

Examples of cold working are cold forging or cold rolling, for example a contact component may be rolled or forged along its longitudinal axis. In other words, the contact component is subjected to forces that lie perpendicularly or substantially perpendicularly to its longitudinal axis. As a result, the grains (arranged randomly after the sintering) of the contact element are deformed in an elongated manner or pulled out or stretched in the direction of the longitudinal axis of the contact element. In other words, the grains of the contact element are given a form, orientation or preferential direction (in the direction of the longitudinal axis of the contact element) that is induced or caused by the cold working. Hollow or tubular contact components, such as for example tulips, may for example be tube-rolled or pulled over a mandrel. Compact contact components, such as for example pins, may be round-hammered. For example, contact components for tulips may also be initially provided in the form of a solid cylinder, which after cold working, such as for example rolling, are drilled through and worked further to provide a tulip form.

The grains of the contact element are preferably in a state of having been deformed in an elongated manner or pulled out or stretched and oriented along the preferential direction. In other words, the grain form of the contact element is elongated and the grains have a greater extent in the direction of their longitudinal axis than perpendicularly to the longitudinal axis. It is assumed that the lower electrical resistance of the contact element in the preferential direction, i.e. in the direction of the longitudinal axis (axes) of the grains that are oriented along the preferential direction, is based on the fact that the current flow in the preferential direction (through the elongated grains) has to pass fewer grain boundaries, grain boundaries having a higher electrical resistance in comparison with the grain volume.

The preferential direction is preferably parallel or substantially parallel to the current conducting direction or the longitudinal axis of the contact component. By this arrangement, the lower resistance of the contact component described above is used particularly efficiently. For example, the preferential direction is parallel or substantially parallel to the longitudinal axis of a tulip or a pin for a circuit breaker.

The contact element is preferably produced from a tungsten alloy, which provides not only great wear resistance and erosion resistance but also good electrical conductivity. For example, WCu is used in a mixing ratio of W:Cu of 90:10, 80:20 or 60:40. According to an alternative refinement, the contact element is produced from MoCu or CuCr.

The contact carrier is preferably produced from copper, which has a high electrical conductivity and good casting properties. Alternatively, CuCr, CuCrZr or other hardenable copper alloys may be used as the carrier material, so that, after the casting-on of the copper carrier, the copper carrier can be hardened by a heat treatment in addition or as an alternative to the cold working.

The contact element is preferably enclosed by the contact carrier material or encapsulated within the contact carrier material. As a result, a connection between the contact element and the contact carrier that extends over a particularly large area and is consequently secure (unbreakable) is produced. In particular, as a result, a good electrical contact between the contact element and the contact carrier is provided, and consequently very good conductivity of the contact component.

There follows a description of a method given by way of example for producing an electrical contact component, in particular an electrical contact component as described above. Firstly, a sintered contact element is provided, onto which a contact carrier is cast. The sintered contact element is produced by various powdered starting materials being mixed, pressed and finally sintered. Optionally, before the casting-on, the sintered contact element is pre-turned. The contact element is placed into a vessel or crucible, such as for example a graphite crucible. Subsequently, the contact carrier material is added to the vessel in one piece, for example as a block or bar, or in smaller parts, for example remains such as chips or offcuts, as powdered material or as granules. The content of the vessel is brought to the melting temperature of the carrier material, so that the carrier material melts and is cast onto the contact element, or the contact element is cast into the carrier material. In other words, the material of the contact element has a higher melting point than the contact carrier material. The contact element is preferably infiltrated by the carrier material, so that a particularly stable connection is produced between the contact element and the contact carrier.

As described above, the contact element is in a cold-worked state or undergoes cold working, so that the grains of the contact element are oriented in a preferential direction. For example, the contact element undergoes cold working before the casting-on, or the contact component as a whole (contact element and contact carrier) undergoes cold working after the casting-on of the contact carrier material, so that the advantages of the contact component described above are provided.

Individual features of the refinements described above of the contact component and of the method for the production thereof and individual features of the contact component and of the method for the production thereof that are described in the following exemplary embodiment may be combined with one another in any way desired.

BRIEF DESCRIPTION OF THE SEVERAL VIEWS OF THE DRAWING

An embodiment of the invention is explained in more detail on the basis of the figures, in which.

DESCRIPTION OF THE INVENTION

Figure 1:
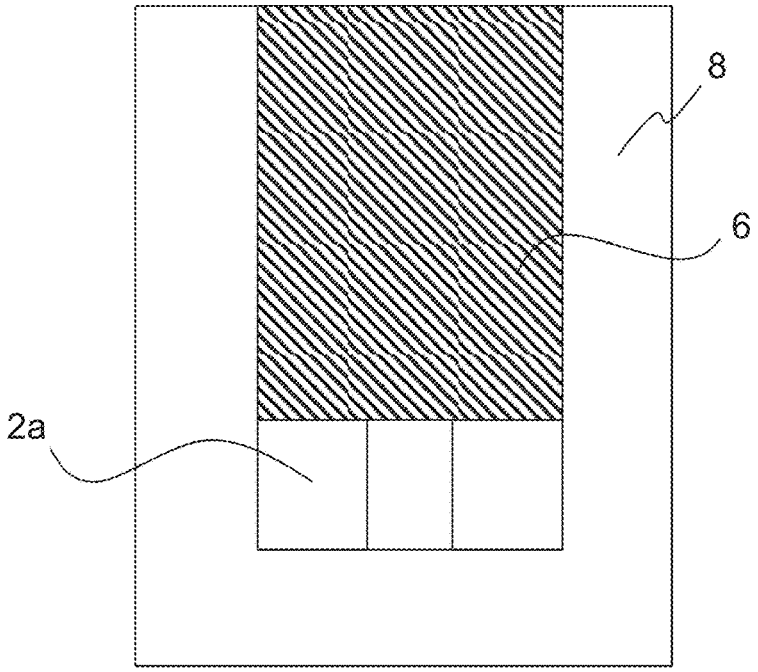
FIG. 1 shows a schematic cross-sectional representation of a vessel with the starting materials for a contact component before a melting process or infiltration process.
Figure 4A:
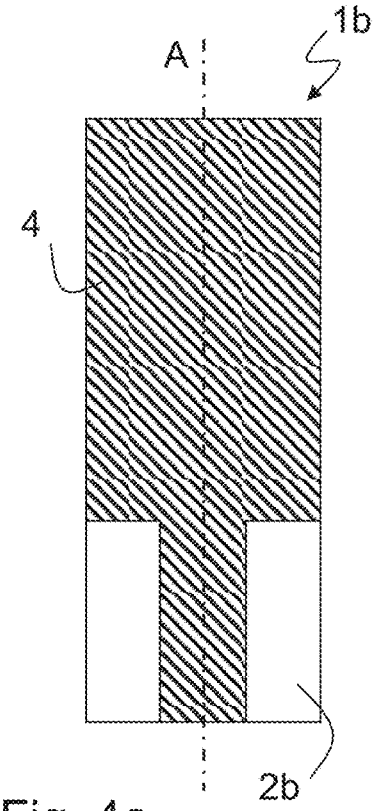
Figure 4B:
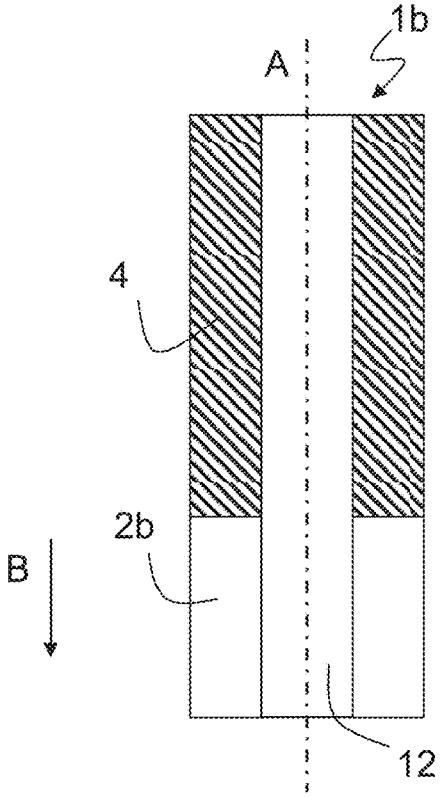

FIG. 1 shows a schematic cross-sectional representation of a vessel 8, such as for example a graphite crucible, with the starting materials for producing a contact component 1*b* (FIG. 4*b*). There follows a description, by way of example, of the production of a contact component in the form of an erosion tulip.

In a first step, a sintered blank 2*a* is provided as a contact element in the vessel 8. In this example, the sintered blank 2*a* has the form of a ring, in order to save sintering material, since the finished contact component has a central through-hole (FIG. 4*b*). For example, a ring of a tungsten alloy, such as for example WCu, is provided. Arranged over the sintered blank 2*a* or the contact element is a block of carrier material 6, for example a block of copper. As an alternative to the block of material 6, comminuted carrier material, such as for example smaller offcuts or powder or granules, may also be used. In other words, metal processing remains may be (re)used, or granules or powder, which is less expensive than for example solid material in bar form.

Figure 2:
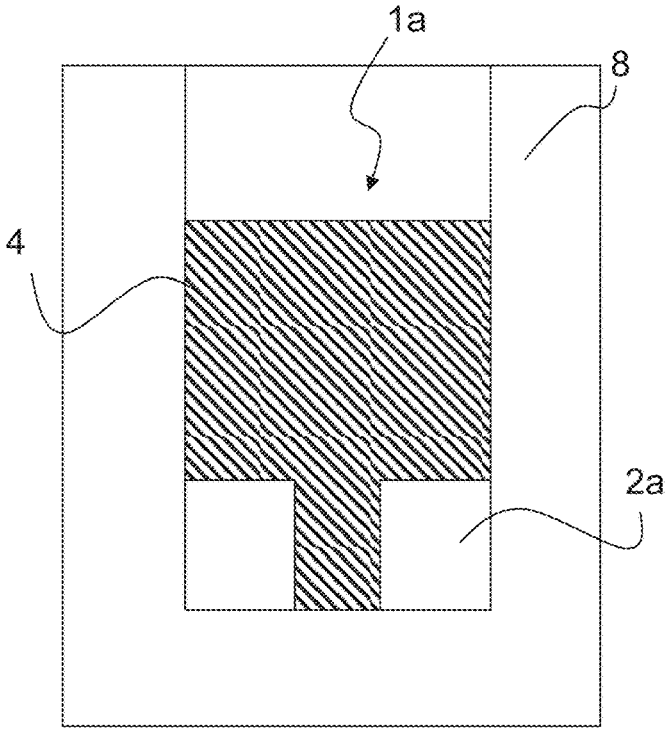
FIG. 2 shows the vessel from FIG. 1 after the melting process for FIG. 3 shows a schematic representation of cold working of the contact component blank from FIG. 2, FIGS. 4*a-b* show a schematic representation of the contact component blank from FIG. 2 after the cold working and a finishing step.

Subsequently, the carrier material is melted and the sintered blank 2*a* is infiltrated with the carrier material, or the sintered blank 2*a* is encapsulated in the carrier material, so that a contact component blank 1*a* is formed. As represented in FIG. 2, the excess carrier material forms the contact carrier 4.

Figure 3:
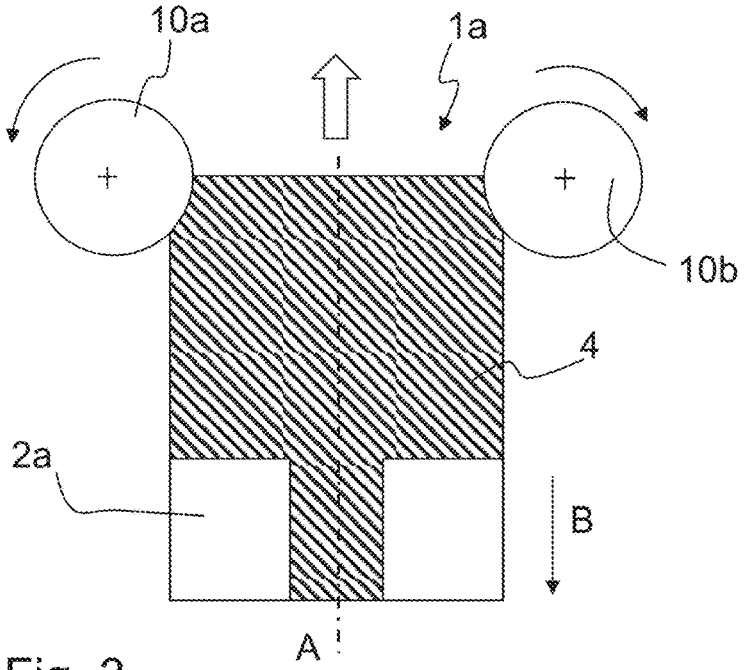

After the casting-on of the contact carrier 4 or the infiltrating of the sintered blank 2*a*, the contact component blank 1 a is removed from the vessel 8 and subjected to cold working. As schematically indicated in FIG. 3 by arrows, the contact component blank 1*a* is moved between two (or more) counter-running rollers 10*a-b* parallel to a longitudinal axis A of the blank 1*a*. By reducing the rolling gap, that is to say the distance between the rollers 10*a-b*, the cross section of the blank 1*a* is reduced or the blank 1*a* is deformed in an elongated manner. In this case, the grains 14*a-c* (arranged or formed arbitrarily due to the sintering process) of the sintered blank 2*a* are rolled flat, that is to say deformed in an elongated manner, pulled out or stretched out in the direction of the longitudinal axis A. After the rolling, the grains 16*a-c* of the blank 2*a* are in a state in which they are oriented along the longitudinal axis A of the contact component. In other words, the grains 16*a-c* of the contact element 2*b* or of the worked sintered blank 2*a* are oriented along a preferential direction B (parallel or substantially parallel to the longitudinal axis A or to the current conducting direction).

The elongated grains 16*a-c* oriented along the preferential direction B have the effect that the contact element 2*b* or the contact component 1*b* has improved conductivity and a lower electrical resistance in the direction B, since the current flowing through the elongated grains 16*a-c* in the preferential direction B has to overcome fewer grain boundaries.

Furthermore, the contact carrier 4 is hardened by the cold working or cold rolling. In other words, predetermined and reproducible mechanical properties can be achieved over the entire volume or the length of the contact component 1*a* by way of the degree of working of the contact carrier 4 or of the contact component 1*a*, irrespective of properties of the starting materials that may deviate from these predetermined properties. In other words, by means of the method described above, a reproducible profile of properties can be achieved for each individual contact component 1*b* in a simple, quick and consequently low-cost way.

The contact component 1*b* schematically represented in FIG. 4*a* after the cold working is subsequently provided with a central hole 12 (FIG. 4*b*) and the contact element 2*b* or the contact component 1*b* is shaped appropriately for the forming of an erosion tulip (not represented).

According to an alternative refinement, provided in the vessel 8 is a central mandrel (not represented), over which the annular sintered blank 2*a* is fitted. The mandrel creates a hollow space in the contact component blank during the casting-on, so that, after the infiltration of the carrier material 6, the hollow space forms the hole 12, or the hollow space only has to undergo minor finishing to obtain the hole 12. In this way, less carrier material has to be melted during production, thereby saving time and energy.

In a way corresponding to the method described above, an erosion pin (not represented) matching the tulip described can be produced with a contact element and a contact carrier cast on it. As a difference from the method described above, in this case the sintered blank does not have the form of a ring, but for example the form of a (solid) cylinder, which forms the contact tip of the pin after the forming of a contact component according to the method described above (without the provision of a hole 12) and is designed to engage in the hole 12 in order to close a switch contact of an electrical switch.

Figure 5:
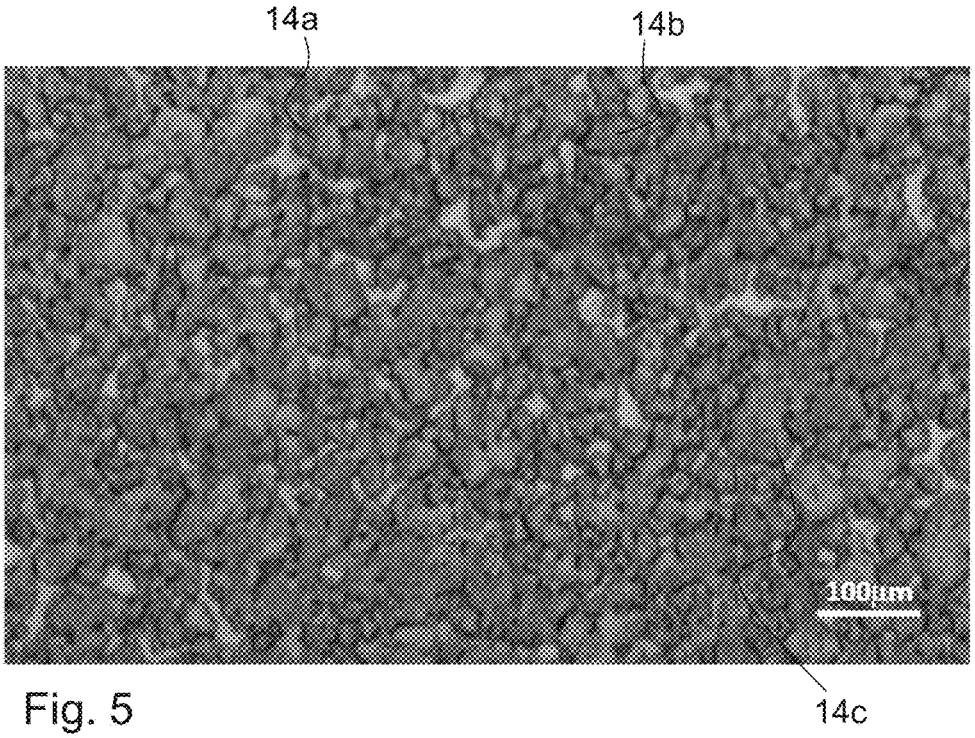
FIG. 5 shows an image of the microstructure of a contact component after a melting or infiltration process.

FIG. 5 shows a depiction of the microstructural state of a contact component in the region of a WCu 80/20 contact element 2*a* after a sintering process and an infiltration process with a carrier material. It can be seen well that grains 14*a-c* of the contact element 2a are formed and arranged arbitrarily.

Figure 6A:
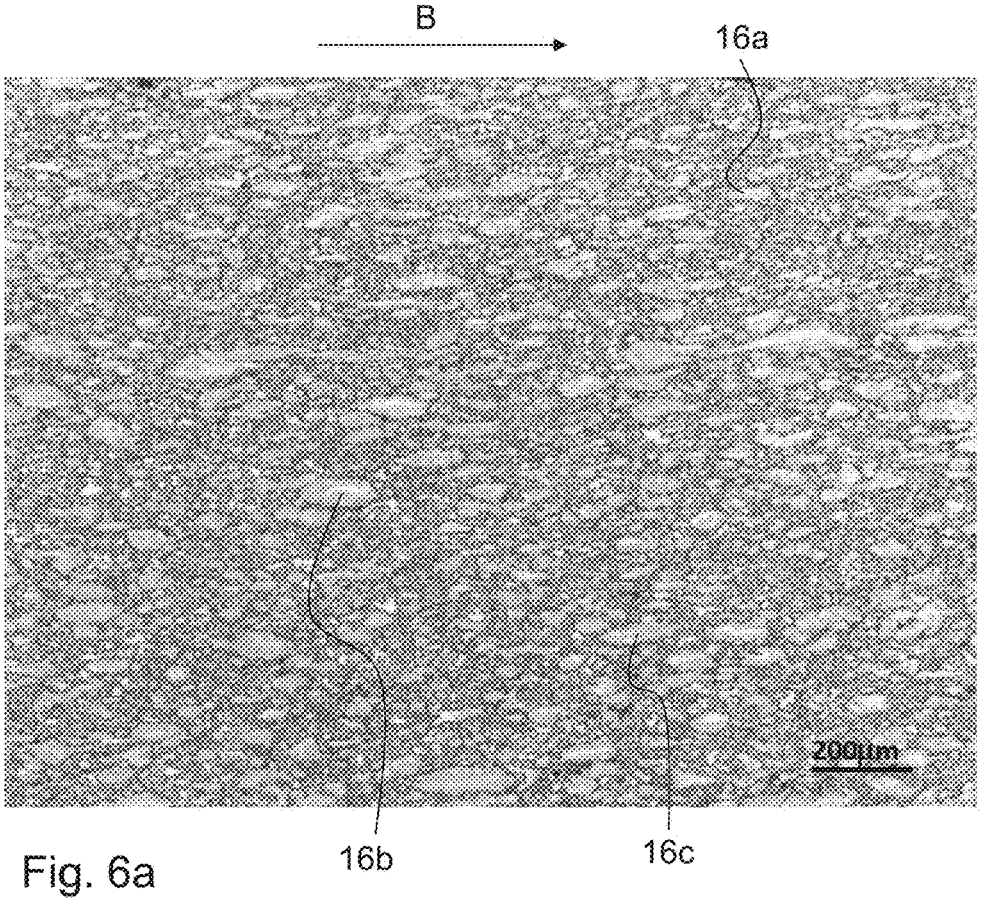
FIGS. 6*a-b* show images of the microstructure of the contact component from FIG. 5 after a working process.
Figure 6B:
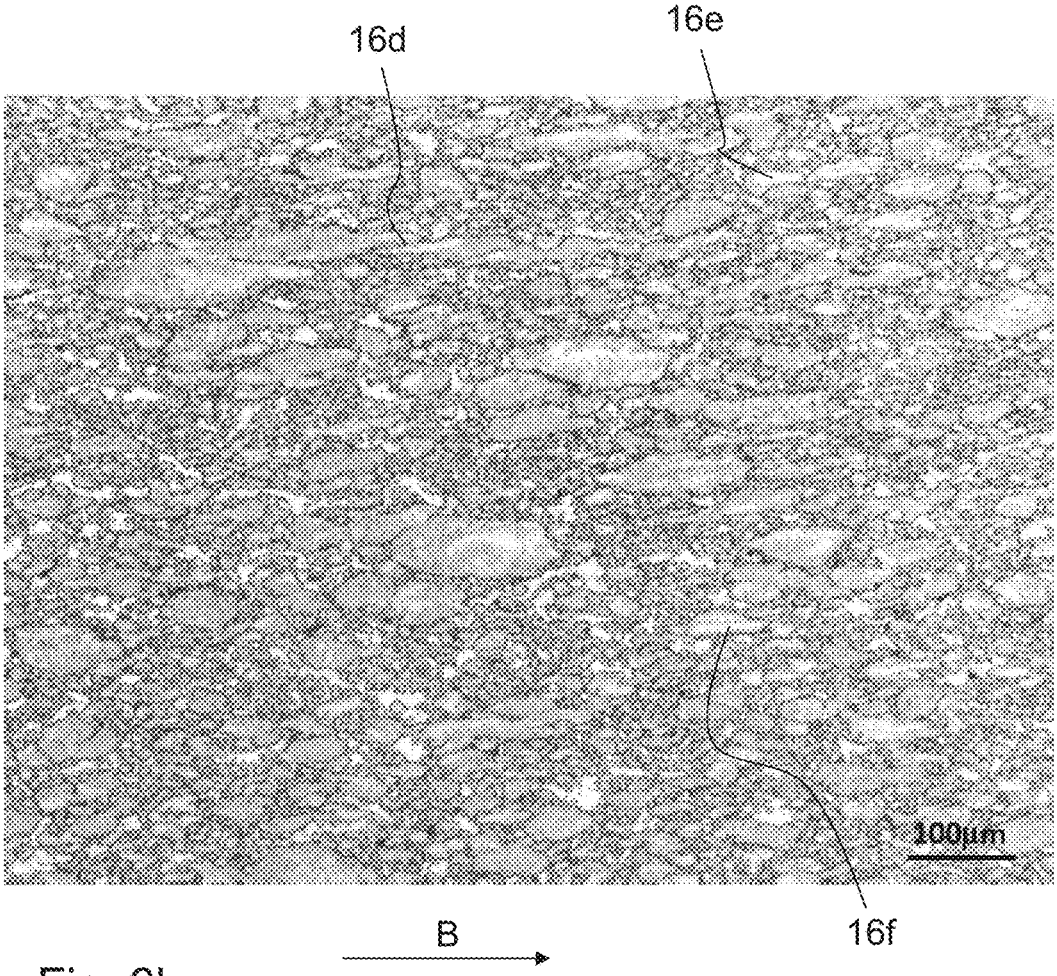

FIG. 6*a* and FIG. 6*b* show the microstructural state of the contact component from FIG. 5 in the region of the contact element after a working process; in this case, the contact component was round-hammered. It can be clearly seen that, as a result of the working, the grains 16*a-c* have a preferential direction B or are in a state of having been deformed in an elongated manner. The electrical conductivity parallel to the preferred orientation B of the worked structure is measurably higher than at right angles thereto. In the present case, this was an improvement of the electrical conductivity of at least 1.5 MS/m.

LIST OF REFERENCE SYMBOLS

1*a* Compact component blank
1*b* Compact component/tulip
2*a* Sintered blank
2*b* Contact element
4 Contact carrier
6 Block of carrier material
8 Vessel/crucible
10*a-b* Roller
12 Hole
14*a-c* Grain after sintering
16*a-c* Grain after working
A Longitudinal axis of the contact component
B Preferential direction

The invention claimed is:

1. An electrical contact component, comprising:
a sintered contact element; and
a contact carrier cast onto said contact element;
said contact element and said contact carrier being elements in a cold-worked state; and
said contact element having grains oriented in a preferential direction.

2. The contact component according to claim 1, wherein said contact element is a cold-worked element to orient said grains of said contact element in the preferential direction.

3. The contact component according to claim 1, wherein said grains of said contact element are elongate in form and oriented along the preferential direction.

4. The contact component according to claim 1, wherein the preferential direction is parallel to, or substantially parallel to, one or both of a current conducting direction and a longitudinal axis of said contact component.

5. The contact component according to claim 1, wherein said contact element is formed of a material selected from the group consisting of WCu, MoCu, and CuCr.

6. The contact component according to claim 5, wherein said contact carrier is formed of a material selected from the group consisting of Cu, CuCr, and CuCrZr.

7. The contact component according to claim 1, wherein said contact carrier is formed of a material selected from the group consisting of Cu, CuCr, and CuCrZr.

8. The contact component according to claim 1, wherein said contact carrier is formed of a hardenable copper alloy.

9. A method of producing an electrical contact component, the method comprising the following steps:
providing a sintered contact element;
casting a contact carrier onto the contact element ; and
cold working the contact element to orient grains of the contact element in a preferential direction.

10. The method according to claim 9, which comprises producing the contact component according to claim 1.

11. The method according to claim 9, which comprises cold working the contact element after the casting-on of the contact carrier.

12. The method according to claim 9, which comprises cold working the contact element and the contact carrier after the casting-on of the contact carrier.

13. The method according to claim 9, which comprises forming the grains of the contact element into an elongated shape.

14. The method according to claim 9, which comprises defining the preferential direction to lie parallel to, or substantially parallel to, a current conducting direction and/or a longitudinal axis of the contact component.

15. The method according to claim 9, which comprises:
cold-working the contact element to thereby subject the contact element to forces that lie perpendicular or substantially perpendicular to a longitudinal axis of the contact element and/or to a current conducting direction of the contact element; or
cold working the contact component to thereby subject the contact component to forces that lie perpendicular or substantially perpendicular to a longitudinal axis of the contact component and/or to a current conducting direction of the contact component.

* * * * *